US007845502B1

(12) United States Patent
Grosz et al.

(10) Patent No.: US 7,845,502 B1
(45) Date of Patent: Dec. 7, 2010

(54) TAPERING-DEPTH SHELVING UNIT FOR USE BEHIND DOORS

(76) Inventors: Anton F. Grosz, 114 Frederick St., #19, San Francisco, CA (US) 94117; Phyllis M. Grosz, 114 Frederick St., #19, San Francisco, CA (US) 94117

( * ) Notice: Subject to any disclaimer, the term of this patent is extended or adjusted under 35 U.S.C. 154(b) by 0 days.

(21) Appl. No.: 12/623,091

(22) Filed: Nov. 20, 2009

(51) Int. Cl.
*A47B 43/00* (2006.01)

(52) U.S. Cl. ..... 211/187; 211/134

(58) Field of Classification Search ..... 211/134, 211/186–188, 189, 183, 87.01, 90.01; 108/107, 108/193, 147.16, 16, 91, 42, 48
See application file for complete search history.

(56) References Cited

U.S. PATENT DOCUMENTS 1,114,790 A * 10/1914 Miller ..... 108/16
5,323,917 A * 6/1994 Johnson et al. ..... 211/74
5,779,067 A * 7/1998 Reaney ..... 211/90.04
6,089,685 A * 7/2000 Ryan et al. ..... 312/351
6,349,507 B1 * 2/2002 Muellerleile ..... 52/36.5
7,395,620 B1 * 7/2008 McNeely et al. ..... 38/137
2002/0046982 A1 * 4/2002 Guizzardi ..... 211/187
2010/0116764 A1 * 5/2010 Lin ..... 211/149
2010/0126952 A1 * 5/2010 Huang ..... 211/134

* cited by examiner

*Primary Examiner*—Jennifer E. Novosad
(74) *Attorney, Agent, or Firm*—PatentBest; Andrew McAleavey

(57) ABSTRACT

A tapering-depth shelving unit is disclosed. The tapering-depth shelving unit is particularly suitable for use in the space behind a door. The shelving unit has two generally vertically extending support members spaced horizontally from one another, with a plurality of shelves mounted generally horizontally between them. The first support member has a depth less than the depth of the second support member, and each of the shelves matches the depth of the first support member on one side edge and matches the greater depth of the second support member along the other side edge. Each of the shelves increases gradually in depth between the first support member and the second support member. The shelves have a generally trapezoidal shape in plan view.

18 Claims, 5 Drawing Sheets

TAPERING-DEPTH SHELVING UNIT FOR USE BEHIND DOORS

BACKGROUND OF THE INVENTION

1. Field of the Invention

The invention relates generally to shelving units, and more particularly to tapering-depth shelving units for use behind doors.

2. Description of Related Art

In 2008, according to a United Nations report, more than half of the world's population lived in urban areas, a first in the course of human history. As time goes on, both the overall population and the percentage of the population living in urban areas are projected to grow. One result of that growth is that living space is increasingly at a premium, particularly in urban areas, and living spaces are becoming commensurately smaller.

As more people live in smaller spaces, they face the challenge of fitting themselves and their possessions into those smaller spaces. Unfortunately, many conventional types of furnishings are not easily adapted to smaller spaces, and it can be difficult to use all of the available space with conventional furnishings.

Shelving units, such as bookshelves, are common and often indispensable places to store possessions. Although some shelving units are designed to be freestanding, most shelving units are designed to be placed against walls; therefore, the number of shelving units that can be placed in a space may be at least somewhat limited by the amount of available wall space.

The task of placing shelving units is further complicated by the fact that in most typical arrangements, some space, like the space behind or immediately proximate to a door, is generally considered to be unusable space, because a conventional shelving unit or another piece of furniture placed behind a door has a great likelihood of blocking the door entirely or preventing it from opening fully.

SUMMARY OF THE INVENTION

One aspect of the invention relates to a tapering-depth shelving unit. The tapering-depth shelving unit includes first and second generally vertically extending support members spaced horizontally from one another, and a plurality of shelves mounted generally horizontally between the first and second support members. The first support member has a depth that is less than the depth of the second support member. Each of the shelves has a shallower side edge whose length defines a first shelf depth that approximately matches the depth of the first support member and a deeper side edge whose length defines a second shelf depth that approximately matches the depth of the second support member. The shelves increase gradually in depth from the first support member toward the second support member. In some embodiments, the shelves may have a generally trapezoidal shape in plan view.

The tapering-depth shelving units are most advantageously used in the space behind a door, in which case their overall shape allows storage of items in that space while also allowing the door substantially the entirety of its unobstructed range of motion.

Other aspects, features, and advantages of the invention are set forth in the description that follows.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
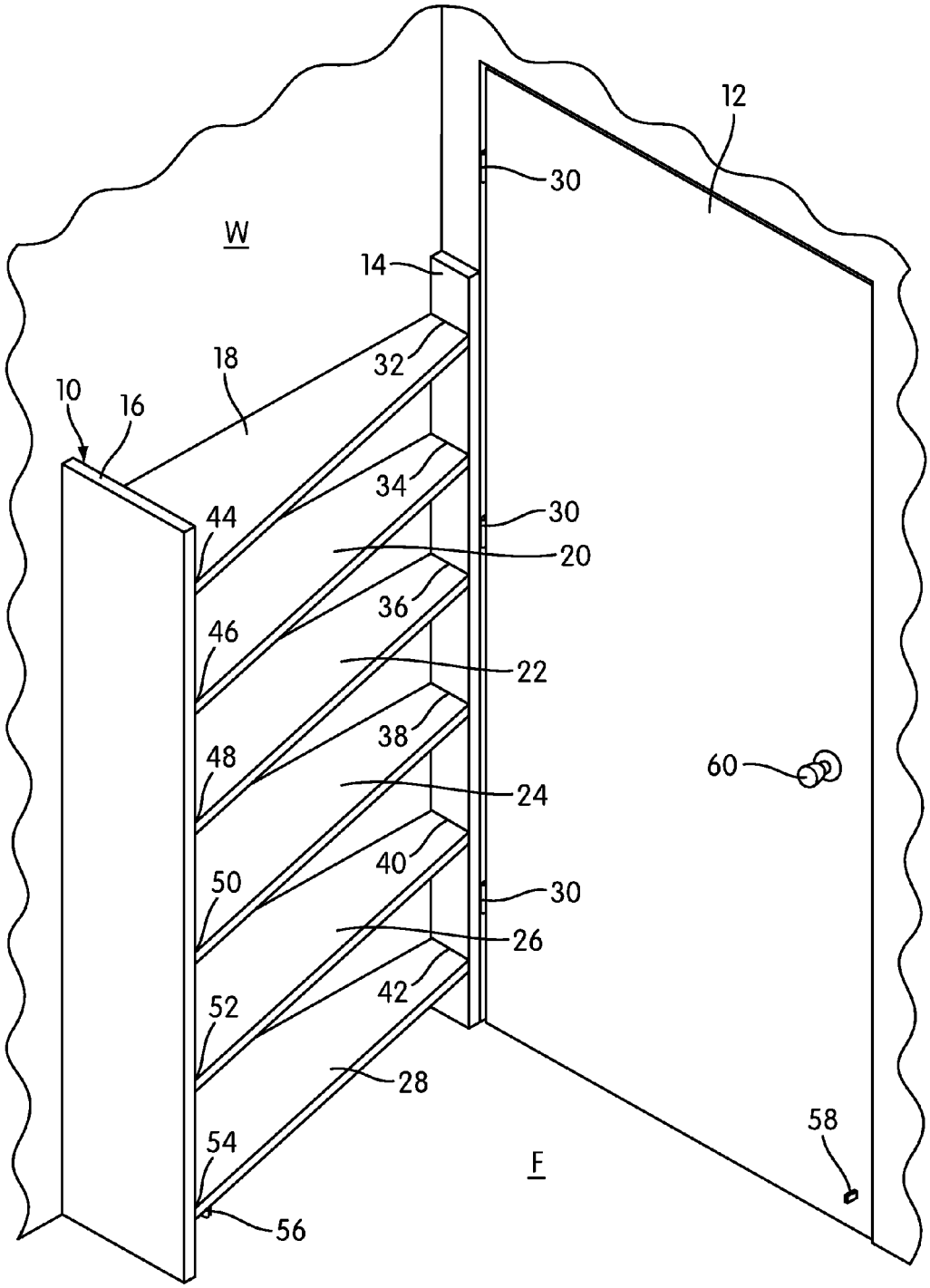
FIG. 1 is a perspective view of one embodiment of a tapering-depth shelving unit, as installed in the space behind a door.

FIG. 1 is a perspective view of a tapering-depth shelving unit, generally indicated at 10, according to one embodiment of the present invention. In the view of FIG. 1, the shelving unit 10 is installed in the space behind a left-opening door 12. The shelving unit 10 has first and second generally vertically extending support members 14, 16 that are spaced horizontally from one another and oriented such that they are parallel with one another, and a plurality of shelves 18, 20, 22, 24, 26, 28 that are mounted between the first and second support members 14, 16.

For purposes of this description, the directional terms "left," "right," "up," and "down," are used with respect to the coordinate system of the drawing figures. Additionally, the term "width" is used to refer to the distance the shelving unit extends horizontally between the first and second support members 14, 16; the term "height" is used to refer to the distance between the floor F and the tops of the first and second support members 14, 16; and the term "depth" is used to refer to the distance the shelving unit 10 extends outwardly from the wall W to which it is parallel.

As shown in FIG. 1, the first support member 14 has a depth that allows it to fit in the space between the hinges 30 of the door 12 and the perpendicular wall W. The second support member 16 has a depth greater than the depth of the first support member 14. Each of the shelves 18, 20, 22, 24, 26, 28 has a shallower edge 32, 34, 36, 38, 40, 42 with a length that is about the same as the depth of the first support member 14 and a deeper edge 44, 46, 48, 50, 52, 54 with a length that is about the same as the depth of the second support member 16. The shelves gradually increase in depth from the first support member 14 toward the second support member 16.

Figure 2:
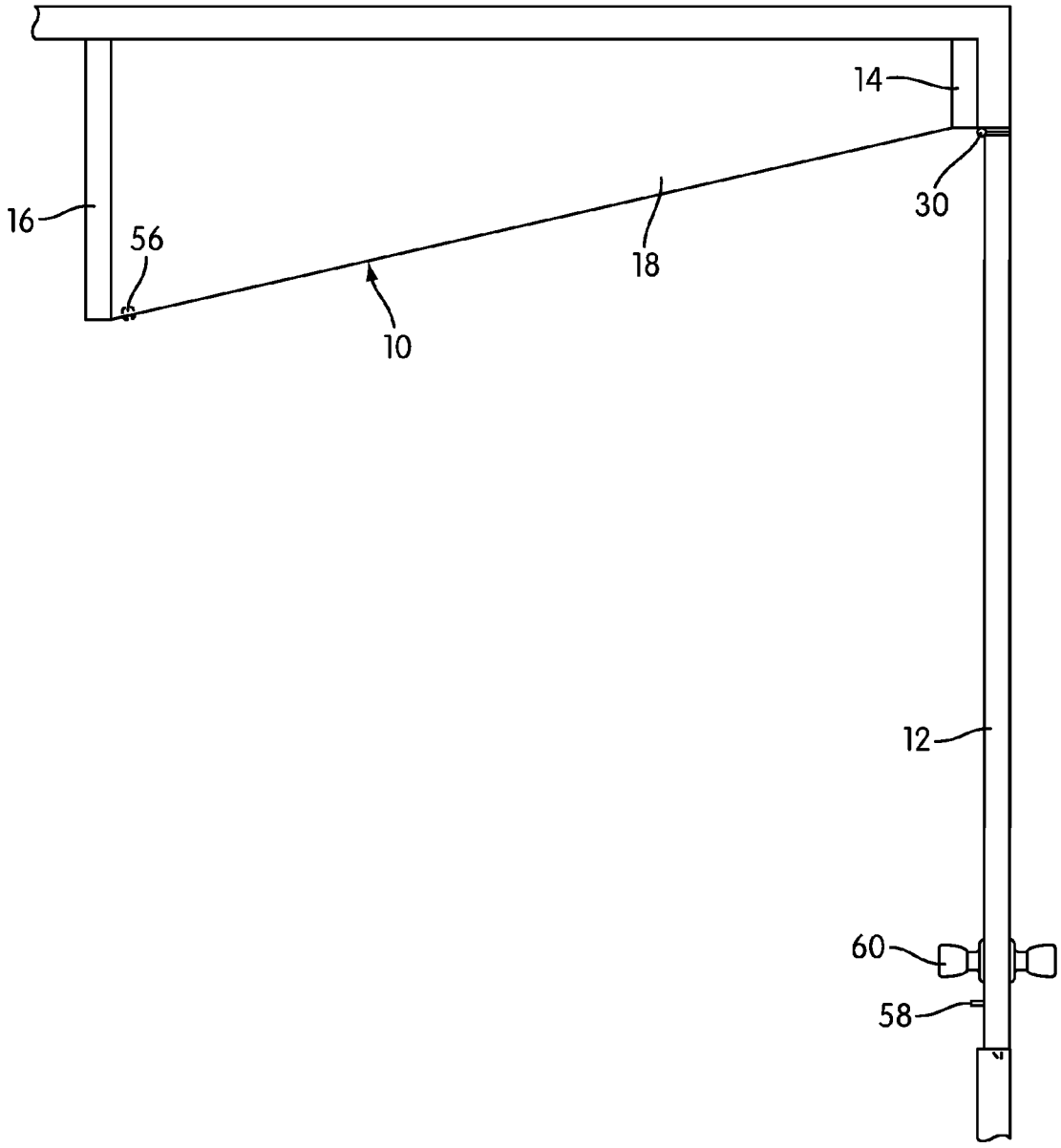
FIG. 2 is a top plan view of the shelving unit of FIG. 1, as installed, with the door in a closed position.
Figure 3:
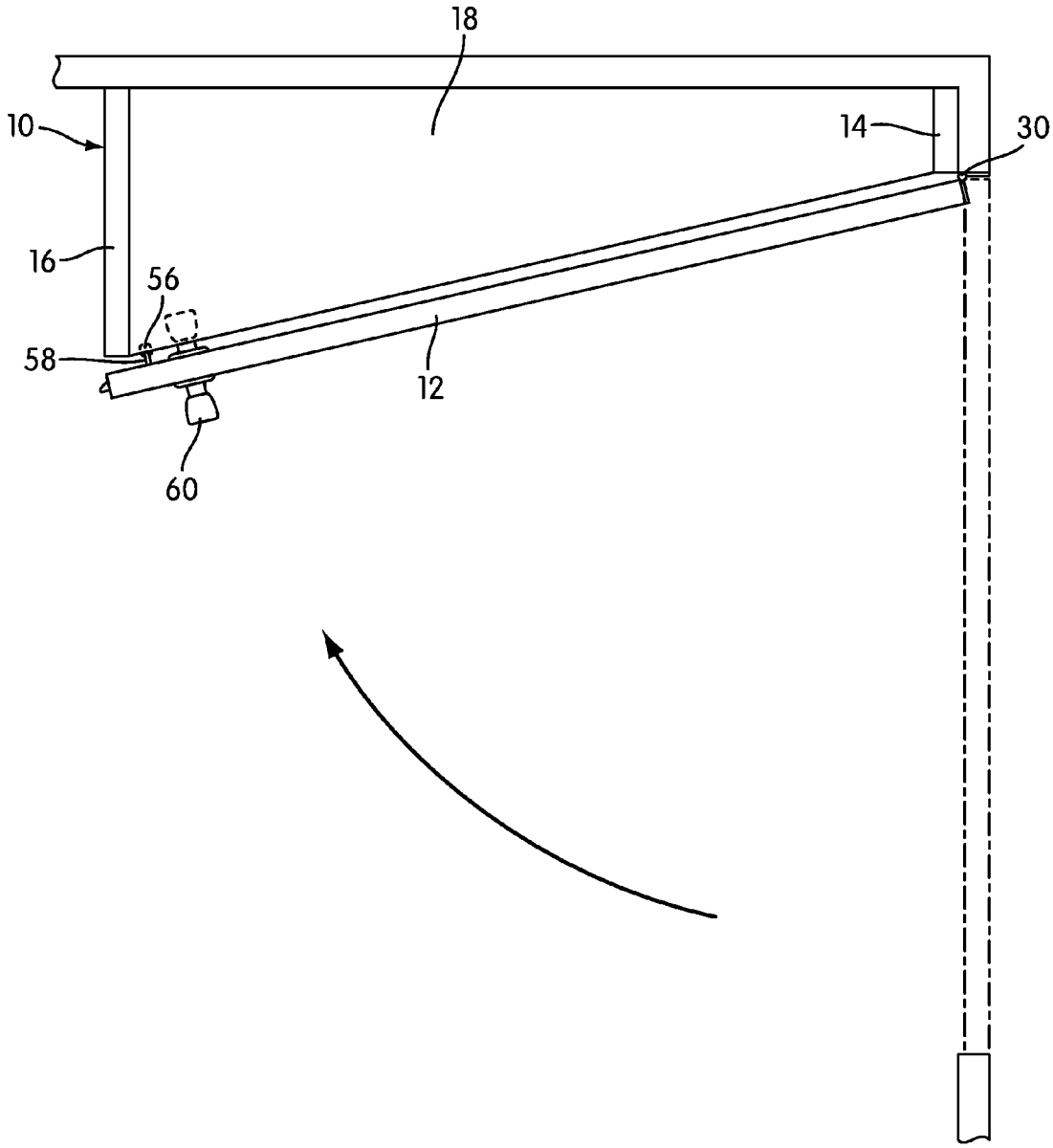
FIG. 3 is a top plan view of the shelving unit of FIG. 1, as installed, with the door in an open position.

In the shelving unit 10, the increase in depth of the shelves 18, 20, 22, 24, 26, 28 is essentially linear along the front edge, which gives the shelves 18, 20, 22, 24, 26, 28 a generally trapezoidal shape, as can be seen in the top plan views of FIGS. 2 and 3, which show the shelving unit 10 in place with the door 12 in closed and open positions, respectively. However, the shelves 18, 20, 22, 24, 26, 28 need not have a trapezoidal shape in all embodiments; some or all of the shelves 18, 20, 22, 24, 26, 28 may have curves, contours, or other features along their front edges, although it may be helpful if all of the shelves 18, 20, 22, 24, 26, 28 terminate at the same vertical plane and have about the same depth as one another. Each of the shelves 18, 20, 22, 24, 26, 28 has at least an upper surface that is generally flat, planar, and adapted to support objects that are placed on it.

FIGS. 2 and 3 also illustrate a particular advantage of the shelving unit 10. When the door 12 is in the closed position shown in FIG. 2, the shelving unit 10 can be freely accessed and items placed on it and removed from it. When the door 12 is in the open position shown in FIG. 3, the door 12 rests against the shelving unit 10. Despite the fact that the shelving unit 10 is behind the door 12, the door 12 can still move through substantially the entirety of its range of motion and open widely; the tapering-depth shelving unit 10 does not present the obstruction that a shelving unit with two vertical supports equal to the depth of the second support member 16 would, and it provides significantly more storage space than a shelving unit with two vertical supports equal to the depth of the first support member 14 would. Moreover, the length of the tapering-depth shelving unit 10 along its diagonal, tapering front edge is approximately equal to the width of the door 12, such that the shelving unit 10 fits neatly behind the door 12 and does not extend beyond it, although the width of the shelving unit 10 and its corresponding length along the tapered front edge need not be limited by the width of the door 12 in all embodiments.

In some embodiments, the shelving unit 10 may carry door catch receiving structure 56, for example, on a lower shelf, that is constructed and arranged to receive and engage a complementary structure 58 carried by the door 12 so as to catch and hold the door 12 in the open position illustrated in FIG. 3. The shelves 18, 20, 22, 24, 26, 28 are also positioned vertically such that the door knob 60 comes to rest between them when it is in the open position illustrated in FIG. 3.

The shelving unit 10 may be made of any suitable materials, including wood, plastics, metals, and combinations of two or more materials, depending on the environment in which it is to be used, the weight and number of items that it is designed to support, and the aesthetic dictates or preferences for the space. Shelving units 10 according to embodiments of the invention may also be made to a variety of sizes and, as will be discussed below in more detail, may be made to accommodate either left-opening or right-opening doors 12.

As one example, a shelving unit 10 may be made of wood, and may have a first support member 14 with a depth of about 3.5 inches (8.9 cm), a second support member 16 with a depth of about 11.5 inches (29.2 cm), and a width along the diagonal front edge of the shelves of approximately 36 inches (91.4 cm). In general, the minimum depth of the shelving unit 10 at the first support member 14 may be determined depending on the amount of space between the door hinges 30 and the wall W. The maximum depth of the shelving unit 10 (i.e., the depth at the second support member 16) may be selected arbitrarily, although if the shelving unit 10 is to be positioned behind a door 12, it is advantageous if the dimensions are selected such that the door 12 is still able to move through substantially the entirety of its range of motion. As shown in FIGS. 2-3, the front edges of the two support members 14, 16 need not be cut along the diagonal to match the taper of the shelves 18, 20, 22, 24, 26, 28, but they may be cut along the diagonal in some embodiments.

Depending on the embodiment, the shelving unit 10 may be attached directly to the wall W with, for example, a figure eight dual washer assembly, an angle bracket, or other appropriate pieces of hardware; it may be braced along its rear with cross braces or a contiguous sheet of material (e.g., wood or pressboard); or it may be both secured to the wall W and braced or given a backing. The shelving unit 10 may also be attached to the wall by inserting a fastener through the first support member 14 and into the wall. In general, any techniques or hardware known in the art may be used to construct, brace, or secure the shelving unit 10.

Of course, although described here as being particularly useful if positioned behind a door 12, shelving units 10 may be free standing, in which case they would typically be braced in the rear, or would include backing material, to rigidify the structure.

Shelving units 10 according to embodiments of the invention may have any number of shelves 18, 20, 22, 24, 26, 28, set in any positions in order to accommodate objects of various heights. For example, although six evenly spaced shelves 18, 20, 22, 24, 26, 28 are shown in FIGS. 1-3, the shelves 18, 20, 22, 24, 26, 28 need not be evenly spaced and may instead be spaced irregularly, such that some shelves 18, 20, 22, 24, 26, 28 can accommodate taller objects.

In some embodiments, the shelves 18, 20, 22, 24, 26, 28 may be formed or molded integrally with the two supports 14, 16. In other embodiments, the shelves 18, 20, 22, 24, 26, 28 may be formed or manufactured separately and then attached to the two supports 14, 16, either at the time of manufacture or at the time that the shelving unit 10 is installed. If the shelves 18, 20, 22, 24, 26, 28 are formed separately and then attached to the supports 14, 16, it may be helpful to cut, rout, or otherwise form appropriately sized horizontal grooves in the supports 14, 16 to accommodate the shelves 18, 20, 22, 24, 26, 28, although that need not necessarily be done in all cases. If they are to be fixed in place, the shelves 18, 20, 22, 24, 26, 28 may be secured by fasteners such as screws, inserted through the support members 14, 16. For example, two or three screws per shelf edge may be used in order to ensure that the shelves 18, 20, 22, 24, 26, 28 are firmly fixed in place. (The shelves 18, 20, 22, 24, 26, 28 need not be rigidly fixed in place, and may instead be removable and positionable, as will be described in more detail below.)

As can best be seen in FIG. 1, the two supports 14, 16 have identical tops and bottoms, so that either end of the shelving unit 10 could be "up" and either end could be "down." This has a particular advantage: one can flip the shelving unit 10 over to accommodate a right-opening door. Of course, this identity or symmetry, while advantageous, is not necessary—one could simply make separate versions or models of the shelving unit 10 for left-opening and right-opening doors.

In the embodiment of FIGS. 1-3, the uppermost and lowermost shelves 18, 28 are at vertical positions that are below the tops and above the bottoms, respectively, of the two support members 14, 16, giving the shelving unit 10 an H-shape. In other embodiments, shelves could be placed so that they are level with the tops and bottoms of the support members 14, 16, respectively. In that case, the uppermost shelf 18 and the lowermost shelf 28 may be permanently joined with the support members 14, 16 so as to define a top and a bottom, respectively, of the shelving unit 10.

The shelving unit 10 may be of any necessary or convenient height, and although shown as being slightly shorter than the door 12 in FIGS. 1-3, it may be taller than the door 12 in other embodiments. As will be described in more detail below, shelving units according to some embodiments of the invention may be significantly shorter than the shelving unit 10.

Figure 4:
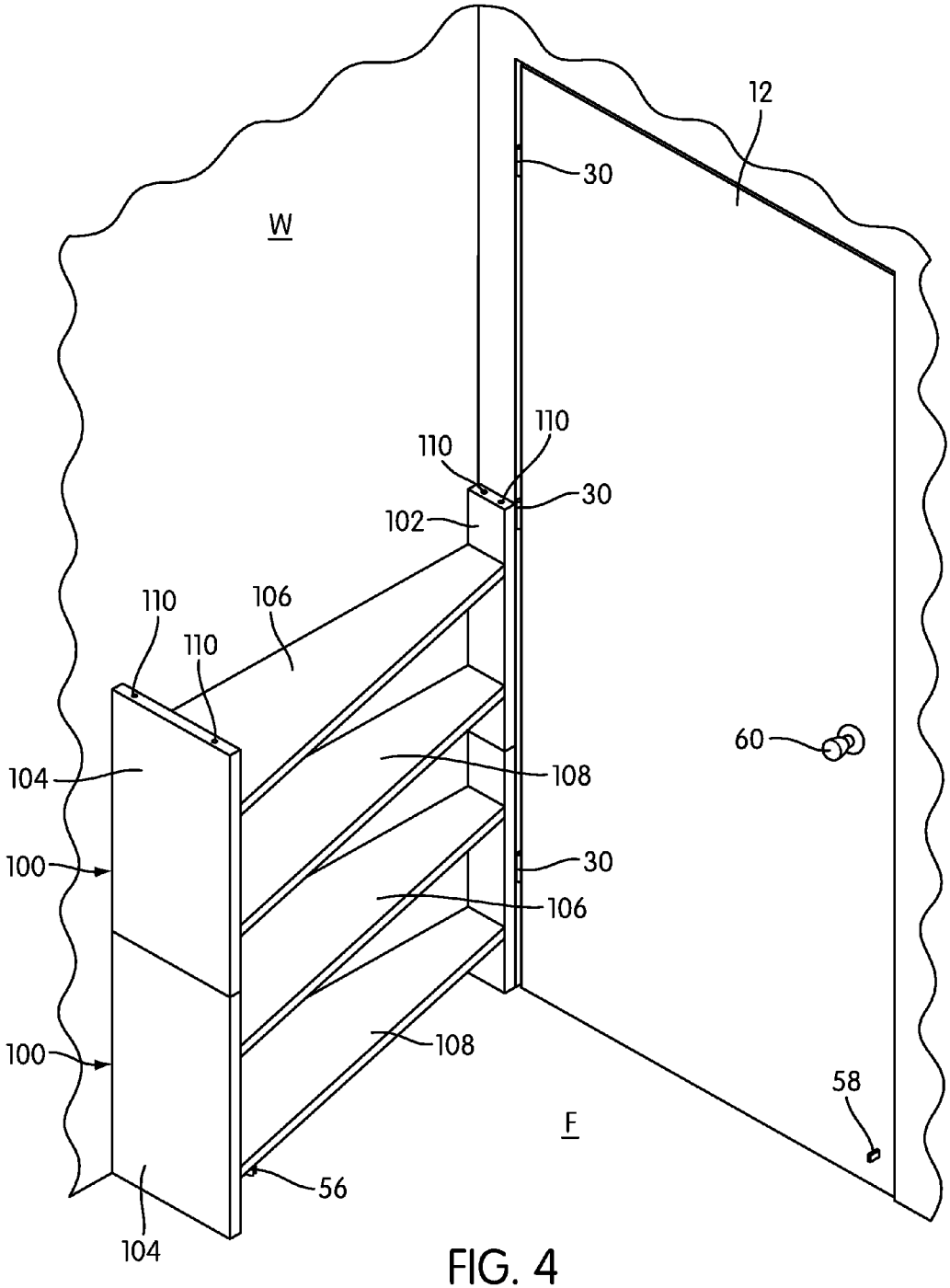
FIG. 4 is a perspective view of a shortened, stackable, tapering-depth shelving unit, as installed in the space behind a door, according to another embodiment of the invention.

FIG. 4 is a perspective view of another embodiment of the invention as installed in the space behind a door 12. In the embodiment of FIG. 4, two relatively short tapering-depth shelving units 100, each one significantly shorter than the door 12, are stacked on top of one another. Each of the shelving units 100 has the same basic features as the shelving unit 10 described above: first and second generally vertically extending support members 102, 104 with generally horizontally extending shelves 106, 108 extending between them. The first support member 102 is of a lesser depth than the second support member 104, and the shelves 106, 108 increase gradually in depth from the first support member 102 to the second support member 104, giving them a generally trapezoidal shape in plan view. The tapering-depth shelving unit 100 differs from the tapering-depth shelving unit 10 of FIGS. 1-3 in that it has only two shelves 106, 108 and is shorter than the tapering-depth shelving unit 10.

The tapering-depth shelving unit 100 is constructed and arranged to be stackable, such that a number of tapering-depth shelving units 100 may be stacked on top of one another to any desired total height. Each tapering-depth shelving unit 100 includes complementary engaging structures to assist in maintaining one unit 100 on top of the other; in the illustrated embodiment, these engaging structures comprise sets of holes 110 in the support members 102, 104 that may be filled with pegs (not shown in the figure) to secure the units 100 together. Alternatively, the units 100 may be secured together with any conventional form of hardware. As with the tapering-depth shelving unit 10, the tapering-depth shelving units 100 may be secured directly to the wall W, or may be braced or backed to provide structural rigidity. When two or more tapering-depth shelving units 100 are stacked together, they may be braced together, if desired, so as to better connect and rigidify the whole. Additionally, although each shelving unit 100 has two shelves 106, 108 in FIG. 4, tapering-depth shelving units 100 may have any number of shelves.

As shown in FIG. 4, the lowermost of the two tapering-depth shelving units 100 has a receiving structure 56 mounted on its lower shelf 108 that is constructed and arranged to engage the complementary structure 58 on the door 12. Depending on the embodiment, each of the tapering-depth shelving units 100 may have such a receiving structure 56 mounted on it. Alternatively, the receiving structures 56 could be provided separately from the tapering-depth shelving units 100 and installed in an appropriate position on the lowermost of the tapering-depth shelving units 100 (or whichever of the tapering-depth shelving units 100 is in the appropriate position to receive the complementary catch structure 58 on the door 12) using nails, screws, or other appropriate fastening means.

Figure 5:
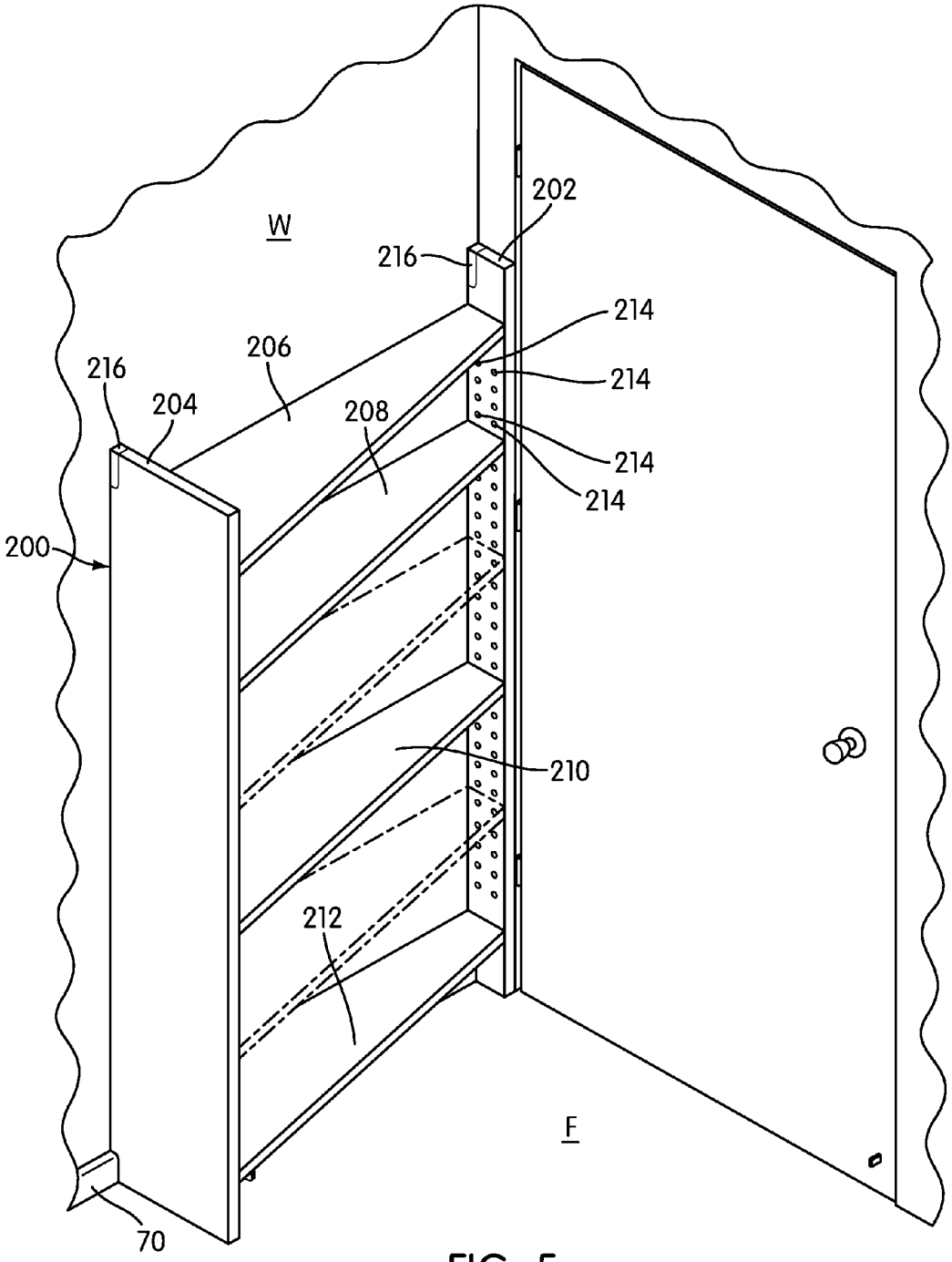
FIG. 5 is a perspective view of a tapering-depth shelving unit with removable, positionable shelves, as installed in the space behind a door.

FIG. 5 is a perspective view of another embodiment of a tapering-depth shelving unit, generally indicated at 200, as installed in the space behind a door 12. As with the other tapering-depth shelving units 10, 100, the tapering-depth shelving unit 200 has two generally vertically extending support members 202, 204, the first support member 202 being of a lesser depth than the second support member 204, and a plurality of shelves 206, 208, 210, 212. The shelves 206, 208, 210, 212 increase gradually in depth from the first support member 202 toward the second support member 204, and have a generally trapezoidal shape in plan view.

The tapering-depth shelving unit 200 has removable, positionable shelves 206, 208, 210, 212. Specifically, the shelves 206, 208, 210, 212 have grooves or slots that are designed to receive pins, support brackets, or other structures to support the shelves 206, 208, 210, 212. Successive pairs of holes 214, spaced vertically along the inwardly-facing surfaces of the first and second support members 202, 204 define respective positions at which pins or other structures can be inserted to support the shelves 206, 208, 210, 212. This arrangement allows a large number of shelves 206, 208, 210, 212 to be included in the shelving unit 200 (in FIG. 5, several shelves are shown in phantom) in essentially any vertical position defined by the pairs of holes 214. The pairs of holes 214 may have any desired vertical pitch (i.e., spacing between successive pairs), although a vertical pitch of about 1-2 inches may provide the greatest degree of flexibility in shelf positioning. Although shown as a feature of the shelving unit 200, shelving units 10, 100 according to other embodiments of the invention may include removable, positionable shelves.

The tapering-depth shelving unit 200 has other advantageous features as well. In many rooms, baseboards 70, which are decorative strips of wood or other materials, run along the joint between the floor F and the wall W. When a room includes baseboards, it can be difficult to position a shelving unit directly against a wall. However, the tapering-depth shelving unit 200 includes frangible portions 216 at the tops and bottoms of each of the two support members 202, 204. The frangible portions 216 are thinned, scored, or otherwise weakened along a line such that they can be broken away to form cut-outs in the support members 202, 204 that are sized and positioned to allow the baseboard 70 to pass behind the shelving unit 200, as is illustrated in FIG. 5. The frangible portions 216 may be, for example, about 1 inch (2.5 cm) in depth and about 4 inches (10.1 cm) in height. Frangible portions 216 may also be included on the tapering-depth shelving units 10, 100 according to the other illustrated embodiments of the invention.

Some embodiments could include cut-outs instead of frangible portions 216. However, one advantage of the frangible portions 216 is that they maintain the ability of the tapering-depth shelving unit to be flipped over on its ends to be used with a left-opening door or a right-opening door while ensuring that whichever ends of the support members 202, 204 face up do not have unnecessary and potentially unsightly cut-outs in them.

Although the shelving units 10, 100, 200 described above are open, unenclosed units, in some embodiments, they may be enclosed. For example, a single door or a set of double doors may be attached to a shelving unit along the front. Doors may be made of wood, metal, plastic, or glass, and may be attached at the time of manufacture or as an option at the time of installation. If doors or other similar structures are included, they may enclose substantially the entirety of the shelving unit, or they may enclose only a portion of it (e.g., a single shelf or a group of shelves). Thus, in some embodiments, a tapering-depth shelving unit may take the form of an enclosed cabinet with a fixed top and bottom, a backing, and a door or pair of doors at the front. The shelving units may also have drawers, bins, or other structures for storing items.

While the invention has been described with respect to certain embodiments, the description is intended to be illuminating, rather than limiting. For example, although certain features have been shown and described with respect to certain embodiments, features from the various embodiments may be combined. In general, modifications and changes may be made within the scope of the invention, which is defined by the appended claims.

What is claimed is:

1. A tapering-depth shelving unit, comprising:

first and second generally vertically-extending support members horizontally spaced from one another to define a shelving unit width, the first and second support members being of about the same height, with the first support member having a first depth that is less than a depth of the second support member; and a plurality of shelves mounted generally horizontally between the first and second support members, each of the plurality of shelves having a shallower side edge whose length defines a first shelf depth that approximately matches the first depth of the first support member and a deeper side edge whose length defines a second shelf depth that approximately matches the depth of the second support member, each of the plurality of shelves increasing gradually in depth from the first support member toward the second support member;

wherein the shelving unit width is greater than the depth of the second support member.

2. The tapering-depth shelving unit of claim 1, wherein the tapering-depth shelving unit is adapted to be installed with the first support member abutting a wall adjacent to a hinged side of a door.

3. The tapering-depth shelving unit of claim 1, wherein the first and second support members are spaced horizontally from and oriented parallel to one another.

4. The tapering-depth shelving unit of claim 1, wherein each of the plurality of shelves has a generally trapezoidal shape in plan view.

5. The tapering-depth shelving unit of claim 4, wherein the generally trapezoidal shape is an asymmetrical generally trapezoidal shape.

6. The tapering-depth shelving unit of claim 1, wherein each of the plurality of shelves is fixedly secured to the first and second support members.

7. The tapering-depth shelving unit of claim 1, wherein first and second ones of the plurality of shelves are fixedly secured to the first and second support members, the first and second ones of the plurality of shelves being vertically spaced from one another.

8. The tapering-depth shelving unit of claim 1, wherein at least some of the plurality of shelves are removable and vertically positionable between the first and second support members.

9. The tapering-depth shelving unit of claim 1, wherein tops and the bottoms of the first and second support members are essentially identical, such that the tapering-depth shelving unit may be supported on either the tops or the bottoms of the first and second support members.

10. The tapering-depth shelving unit of claim 9, wherein the first and second support members have frangible portions proximate to their tops and bottoms, the frangible portions being sized and arranged such that, when removed, a baseboard can pass behind the first and second support members with the shelving unit flush against a wall to which the baseboard is attached.

11. The tapering-depth shelving unit of claim 1, further comprising door catch cooperating structure attached to a portion thereof.

12. A tapering-depth shelving unit, comprising:

first and second generally vertically-extending support members horizontally spaced from one another to define a shelving unit width, the first and second support members being of about the same height, with the first support member having a first depth that is less than a depth of the second support member; and a plurality of shelves mounted generally horizontally between the first and second support members, each of the plurality of shelves having a shallower side edge whose length defines a first shelf depth that approximately matches the first depth of the first support member and a deeper side edge whose length defines a second shelf depth that approximately matches the depth of the second support member, the shelf increasing gradually in depth from the first support member toward the second support member, so as to have a generally trapezoidal shape in plan view;

wherein the tapering-depth shelving unit is constructed and arranged to fit behind a door with the first support member fitting in the space immediately adjacent to a hinge of the door; and wherein the shelving unit width is greater than the depth of the second support member.

13. The tapering-depth shelving unit of claim 12, wherein at least some of the plurality of shelves are removable and vertically positionable between the first and second support members.

14. The tapering-depth shelving unit of claim 12, wherein the tops and the bottoms of the first and second support members are essentially identical, such that the tapering-depth shelving unit may be supported on either the tops or the bottoms of the first and second support members.

15. The tapering-depth shelving unit of claim 14, wherein the first and second support members have frangible portions proximate to their tops and bottoms, the frangible portions being sized and arranged such that, when removed, a baseboard can pass behind the first and second support members with the shelving unit flush against a wall to which the baseboard is attached.

16. A method of storing items, comprising:

placing a tapering-depth shelving unit in the space behind a door, the tapering-depth shelving unit including first and second generally vertically-extending support members horizontally spaced from one another to define a shelving unit width, the first and second support members being of about the same height, with the first support member having a first depth that is less than a depth of the second support member, and a plurality of shelves mounted generally horizontally between the first and second support members, each of the plurality of shelves having a shallower side edge whose length defines a first shelf depth that approximately matches the first depth of the first support member and a deeper side edge whose length defines a second shelf depth that approximately matches the depth of the second support member, the shelf increasing gradually in depth from the first support member toward the second support member, such that the first support member rests against a space immediately adjacent to an axis of rotation of the door and a width of the tapering-depth shelving unit extends along a wall perpendicular to the door in a closed position; and storing items on the tapering-depth shelving unit.

17. The method of claim 16, further comprising securing the tapering-depth shelving unit to the wall perpendicular to the door.

18. A tapering-depth shelving unit, comprising:

first and second generally vertically-extending support members horizontally spaced from one another to define a shelving unit width, the first and second support members being of about the same height, with the first support member having a first depth that is less than a depth of the second support member; and a plurality of shelves mounted generally horizontally between the first and second support members, each of the plurality of shelves having a shallower side edge whose length defines a first shelf depth that approximately matches the first depth of the first support member and a deeper side edge whose length defines a second shelf depth that approximately matches the depth of the second support member, each of the plurality of shelves increasing gradually in depth from the first support member toward the second support member;

wherein the tapering-depth shelving unit has an asymmetrical, generally trapezoidal shape in plan view.

* * * * *